United States Patent [19]

Buchholz et al.

[11] 4,414,056

[45] Nov. 8, 1983

[54] METHOD AND APPARATUS FOR FOIL-CAPPING BOTTLES

[75] Inventors: Rainer Buchholz, Düsseldorf; Josef Tomashauser, Tönisvorst; Rudolf Zodrow, Düsseldorf; Hans-Werner Mohn, Kaarst, all of Fed. Rep. of Germany

[73] Assignee: Jagenberg Werke AG, Düsseldorf, Fed. Rep. of Germany

[21] Appl. No.: 314,335

[22] Filed: Oct. 23, 1981

[30] Foreign Application Priority Data

Dec. 11, 1980 [DE] Fed. Rep. of Germany ..... 3046615
Feb. 11, 1981 [DE] Fed. Rep. of Germany ..... 3104807

[51] Int. Cl.[3] ..... B65C 3/22

[52] U.S. Cl. ..... 156/476; 156/485; 156/486; 156/488; 156/493; 156/567; 156/568; 156/DIG. 16

[58] Field of Search ..... 156/475, 476, 485, 486, 156/488, 489, 493, 567, 568, DIG. 15, DIG. 16, 212

[56] References Cited

U.S. PATENT DOCUMENTS 2,297,720 10/1942 Schmutzer et al. ..... 156/DIG. 16
2,683,549 7/1954 Phin et al. ..... 156/DIG. 15
2,695,721 11/1954 Fairest ..... 156/DIG. 15
3,707,417 12/1972 Dullinger ..... 156/212
3,823,050 7/1974 La Mers ..... 156/493
4,306,926 12/1981 Pfulb ..... 156/DIG. 16
4,338,155 7/1982 Buchele ..... 156/567

*Primary Examiner*—Michael G. Wityshyn
*Attorney, Agent, or Firm*—Sprung, Horn, Kramer & Woods

[57] ABSTRACT

There is described an apparatus and a method for the foil-capping of bottles with a patch of metal foil having a point and an adhesive back, comprising (a) adhering each patch to the neck of a bottle by its central area with the upper area of the foil projecting above the bottle neck,
(b) applying the laterally projecting patch ends so that they overlap one another,
(c) folding down the area of each patch projecting above the bottle neck to the bottle side away from the patch point, and
(d) simultaneously pressing down and smoothing the folded down patch area onto the top side and all about the circumferential margin adjacent thereto.

A neater tear-free arrangement of the foil about the top and sides of the neck of the bottle results.

29 Claims, 17 Drawing Figures

METHOD AND APPARATUS FOR FOIL-CAPPING BOTTLES

BACKGROUND

Figure 1:
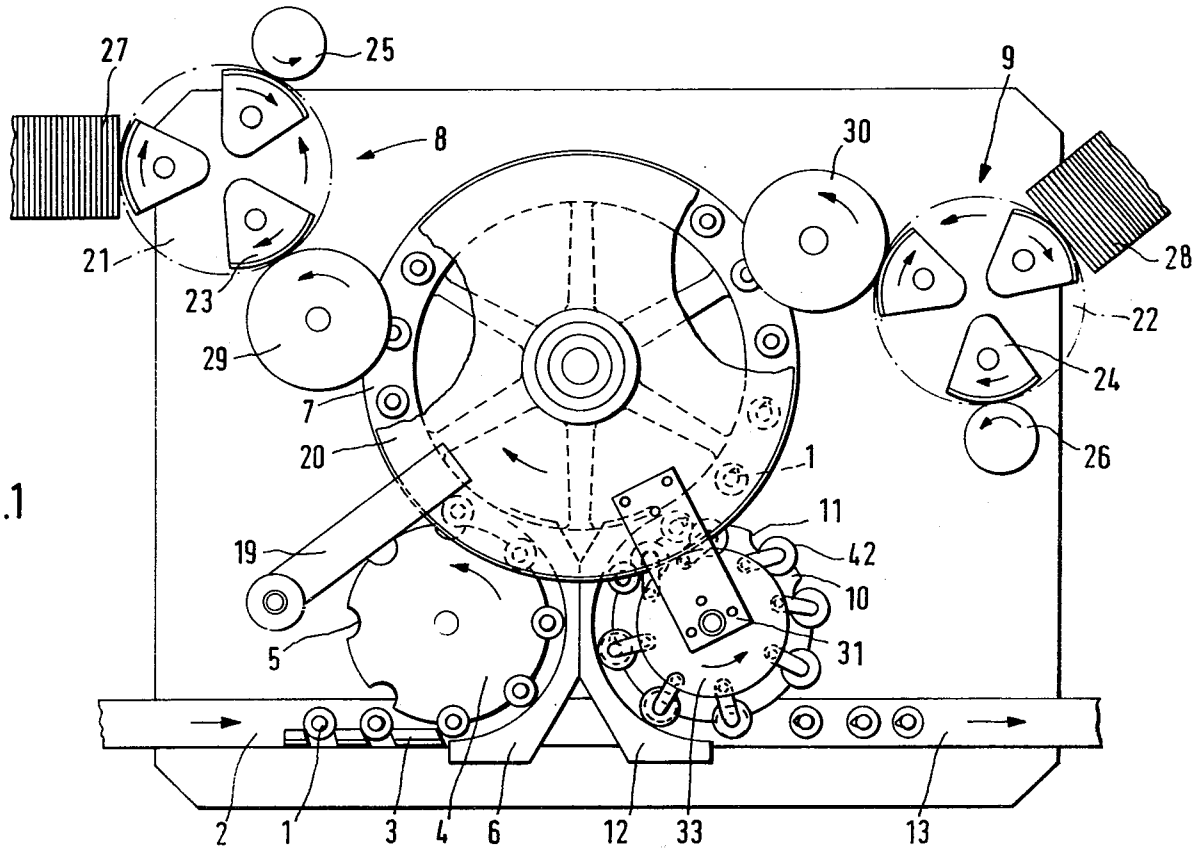

The invention relates to an apparatus for foil-capping bottles, especially with a patch of foil having a point, the apparatus having a turntable containing a plurality of controlled bottle turning devices disposed on its circumference, having at least one labeling station which transfers the foil patches (and other labels if any) onto the bottles which the turntable is carrying past the labeling station and which are turned to a particular rotational position, having elements disposed along the bottle transport path determined by the turntable, which elements press down the foil patches (labels) transferred onto the bottles, and having a transfer wheel which succeeds the turntable and has receptacles for the bottles, and which has a means for gripping the bottles and a system for pressing down the ends of the foil which project above the tops of the bottles.

In known apparatus of this or a similar kind for the capping of bottles with a rectangular patch of foil, the bottles provided by the labeling station with a rectangular patch of foil with one corner pointing downwardly are brought to such a rotational position that, when the bottles enter the transfer wheel, the foil patches are situated with their points on the back of the bottle with reference to the transport direction. The bottles are held in this rotational position by the gripping means of the transfer wheel until the bottles have moved past a means stationarily disposed above the bottle receptacle in the transfer wheel and turning down the upstanding end of the foil patch. When the gripping means in the form of cam-controlled clamps are released, the bottle is set in rotation by rolling against an outer, fixed guide as it is moved along by the transfer wheel. To facilitate this rotation of the bottles, the bottle is urged against freely rotatable rollers in each receptacle in the transfer wheel. As the bottle continues to move along while rotating in this manner it comes within reach of rotating brushes which press down the turned-down end of the patch as well as the patch area adjacent the head, but also all the rest of the foil, against the bottle. After the treatment by the brushes, the bottles come in reach of an arcuate smoothing piece acting on the top end of the bottle. When this multi-step treatment of the upstanding end of the patch has been completed, it is necessary to stop the bottle from rotating by again actuating the gripping means, so that the bottles can be pressed as gently and smoothly as possible through the exit onto a conveyor belt that carries them away.

In an apparatus of this sort, since the bottle that enters the transfer wheel is set in rotation by friction with the outer guide, the label, whose glue has not yet set, is subjected to considerable distress, especially in the acceleration and stopping of the bottle (German Auslegeschrift No. 2,734,932).

THE INVENTION

It is the object of the invention to create an apparatus of the kind mentioned above, which will handle the bottles more gently in the foil capping operation, while being of simple construction.

This object is achieved in accordance with the invention by the fact that the gripping means holds the bottles against rotation on their entire course through the transfer wheel, that the down-turning and pressing means consists of a plurality of similar units associated one with each bottle receptacle, disposed above the transfer wheel and revolving with the transfer wheel, each unit being pivotable under the control of the rotational movement of the transfer wheel from a first position laterally alongside the corresponding receptacle to a second position above the receptacle, and in this position being lowerable axially against the top of the bottle held in its receptacle, and consisting of a down-turning means and a smoothing and pressing element which is disposed behind the down-turning means with respect to the direction of movement from the first position to the second position, and which, when lowered, envelops the bottle top on all sides.

In the apparatus of the invention, the individual rotation of the bottles in the exit transfer wheel is eliminated. This makes the labeling process much more gentle. Since with each bottle receptacle in the transfer wheel there is associated one pivoting unit composed of a down-turning means and a smoothing and pressing element, all the time during which the bottle is being carried by the transfer wheel is available for turning the foil patch down, and pressing it smooth. In other words, the turning down of the foil cap can be performd more slowly and hence more gently than it is in the known apparatus.

If the apparatus for the foil-capping and labeling of bottles is constructed with two labeling stations, the first in the direction of rotation of the turntable applying the front label and the patch of foil and the second the back label, it will not even be necessary, in accordance with a development of the invention, to change the rotational position of the bottles in the turntable for the application of the back label if the pivoting movement of each unit from the first position to the second position is co-directional with the rotation of the transfer wheel.

Since in the apparatus of the invention one unit accompanies the movement of each receptacle in the transfer wheel, the unit can be pivoted over the receptacle from either side, but the pivoting movement in the desired case can best take place from the rear in order to avoid the otherwise necessary additional rotational control and the complication of the labeling which this entails.

The gripping means can be of various kinds. According to a first embodiment, it consists of a pad fixedly associated with each bottle receptacle and having a surface with a high coefficient of friction, and of a stationary guide disposed at the outer circumference of the transfer wheel and turning with it or having a surface of low coefficient of friction, the stationary guide urging the bottles against the pad. This embodiment of the invention is distinguished by the simplicity of its design.

In an alternative embodiment, the gripping means consists, in a known manner, of a clamp controlled by the rotational movement of the transfer wheel. The clamp can consist of a pivoting lever which holds the bottle tightly in the pocket of the receptacle. This embodiment of the invention, in conjunction with an additional embodiment, offers the advantage of selectively removing faulty bottles. This additional embodiment is characterized by the fact that the transfer wheel has two outlets which can be selected by the control means, and that an additional control is provided which has priority over this control means, and which determines, on the basis of defects detected by at least one sensing means, which of the two outlets is to be opened by the first control means. Preferably, the first control means consists of two parallel, stationary control cams by which the clamp can be brought selectively in engagement by means of an actuator. The time during which the bottle is being treated by the unit equipped with the down-turning means and the pressing and smoothing element can be utilized for the selection of the cams. Thus an additional proposal of the invention provides that the actuator is disposed in a cam-free area, and that the cam follower of the drive, when shifted from its basic position associated with the first cam to the second position associated with the second cam, can be held in the second position, and is returned to the basic position by a deflector at the end of the second cam.

With this embodiment of the clamp serving as a gripping means, therefore, not only is the bottle held against rotation while it is transported by the transfer wheel, but also the segregation of defective bottles is accomplished.

The control of the pivoting movement of the individual units can be accomplished by means of a fixed cam common to all of the down-turning and pressing units. Likewise, a fixed cam common to all units can be provided for controlling the downward movement of the individual units. Both as regards construction and as regards use in conjunction with bottles which are to be foil-capped and those which are not, the following embodiments are desirable. The units are mounted in a dependent frame disposed above the transfer wheel and driven through a coupler by the transfer wheel. The units are releasably suspended from operating spindles extending downwardly from the frame. The coupler is fixedly but removably mounted on the upper side of the transfer wheel and can be axially locked to the frame.

With these embodiments, if the apparatus has to be converted from the handling of bottles which are to be foil-capped to the treatment of those which are not, the coupling unit is unfastened from the transfer wheel, lifted axially upward and locked in the frame, and the pivoting units are dismounted from the operating spindles. Now, only bottles which are to be labeled only can be handled by the apparatus, without interference from the parts provided for foil-capping. Since the pivoting units are mounted, not in the transfer wheel, but in a frame disposed above it, the disks of which the wheel is composed can be made light in weight. Since they do not need to accommodate any rollers, but need only to provide receptacles for the bottles, they can be made of polyurethane foam. On the basis of this resilient material in the transfer wheel, the handling of the bottle is quiet and gentle. These light and inexpensively manufactured parts of the transfer wheel also facilitate conversion to different bottle sizes.

The smoothing and pressing element consists preferably of a central portion which is resiliently yielding under pressure from the top of the bottle, and an outer, annular portion which envelops the edge of the bottle neck when the central portion yields.

In a first embodiment, the central portion and the annular portion consist of an integral sponge. Particularly good results are achieved if the sponge is supported on its back and sides by the bottom and the walls of an inverted cup. The bottom of the cup can at the same time have a recess in its center. The sponge can furthermore have the basic shape of a truncted cone whose larger bottom confronts the top of the bottle. It has been found that, with a smoothing and pressing element of this kind, little stress is applied to the foil and the surface of the sponge rolls uniformly over the edge to apply radial pressure against the foil.

The sponge can have projections on its circumference, especially a collar whereby it is held in a corresponding recess in the cup.

In an alternative embodiment of the smoothing and pressing element, the central part is a resiliently supported plunger and the annular part is loosely mounted in an internal recess in a means for holding it. The annular part can consist of a coil spring. Preferably, the annular part is of circular cross section. In this embodiment, too, the annular part acting on the rim of the bottle rolls very gently on the surface of the foil.

The down-turning means can be a finger disposed transversely of the pivoting movement, especially one bearing a freely rotating roller. Furthermore, the down-turning means can be resiliently supported to compensate for slight differences in the height of the bottles.

Constructing the unit with a spiral spring offers the possibility of creating pleats or ruffles in the neck area of the foil applied to the bottle. All that is necessary for this purpose is to lower the unit farther than would be necessary for the purpose of turning down the upstanding part of the foil against the top of the bottle.

Bottles nowadays are given a more attractive treatment by giving the foil a pointed configuration, i.e., by applying rectangular pieces of foil to the neck and top of the bottle with one corner pointing downwardly. To enable the top of the bottle to be covered completely when the upstanding corner is folded down, it is common practice to make the upstanding corner project rather far above the bottle top. When so much of the foil is thus projecting, and is twisted together and pressed down, it is hardly possible to flatten it in a satisfactory manner. Another disadvantage is that rather a great deal of foil is wasted on account of the amount that has to project in order to achieve complete coverage.

These disadvantages also exist in the case of "butt wrapping" with foil, i.e., when a foil patch of pentagonal shape is applied with one edge running horizontally about the bottle. In this kind of foil-capping, another disadvantage is encountered, namely that of the more expensive production of the pieces of foil on account of the five cut edges.

These disadvantages can be avoided in an additional embodiment of the apparatus of the invention, since it makes it possible to use rectangular foil pieces for butt-wrapping. In accordance with this embodiment, each unit bearing the down-turning means and the smoothing and pressing element can pivot from its first position to a third position opposite the second position, and it bears an additional down-turning means which corresponds in its radial dimensions to the collar-like upstanding portion of the foil, and in the third position it is situated closely above the top of the bottle.

With an apparatus thus constructed for the foil-capping of bottles, the foil patches are not only treated gently, but also the apparatus assures a modest consumption of foil and a perfect appearance of the bottle top, because the two turning actions performed by the two down-turning means in opposite directions avoid any particularly great pile-up of material on the bottle top. In the extreme case, when rectangular pieces of foil are used for butt-wrapping, it would suffice for the upstanding part of the foil to project on both sides by an amount corresponding to half the diameter of the bottle top. As a rule, of course, slightly more will be used to permit overlapping. Since the unit for the one down-turning means also bears the second down-turning means, the cost of providing this additional down-turning means is quite low. Since the unit must be able to pivot anyway, and its pivoting movement has to be controlled, it is necessary only to design the control accordingly, for example by adapting the configuration of the cam accordingly. The cam can be designed such that, even if it were not actually necessary to do so (unit having no second pressing member), it will pivot the unit to the third position. The same machine can be equipped with different units according to the desired style bottle.

The additional down-turning means is preferably in the form of a plunger. A down-turning means of this kind, when pivoted from the side, pushes its way into the collar-like upstanding portion of the foil piece. This puts little stress on the material, and a specific folding in of a portion of one side takes place, onto which portion the other side can be folded down without forming a bulge.

To enable the down-turning means on the one hand to be able to pass as close as possible to the rim of the bottle top, and on the other hand to prevent any collision between the down-turning means and the top of the bottle even if the bottles are not all of precisely the same height, the additional down-turning means is mounted in a resiliently yielding manner.

To prevent the upstanding portion of the foil piece from becoming distorted when the piece is applied to the bottle while the latter is still on the turntable, each centering head of the turning means of the turntable has a substantially cylindrical or slightly truncoconical outer periphery of the same outside diameter as the top of the bottle, which serves as a mold for the shaping of the upstanding, collar-like portion of the foil patch when the latter is transferred to and applied laterally against the bottle. Of the two alternatives the truncoconical configuration is the better, because it is easier to extract upwardly out of the collar-like upstanding portion of the foil.

The invention furthermore relates to a method for the foil-capping of bottles with a patch of metal foil, especially one that is pointed and has an adhesive back, this method consisting of the following steps:

(a) Adhesion of the foil at its central portion to the neck of the bottle, with one corner pointing downwardly if desired, and with its opposite corner projecting upwardly above the bottle top.
(b) Laying down of the laterally projecting corners of the piece, especially with overlapping.
(c) Folding over of the portion projecting above the neck of the bottle, especially over the top and down on the side of the bottle opposite the downwardly pointing corner.
(d) Pressing down and smoothing of the folded-over portion of the foil.

A method of this kind, which is known from the above-discussed state of the art, is characterized in accordance with the invention by the fact that the smoothing and pressing down of the overfolded portion of the foil against the top of the bottle and the circumferential margin adjoining same is performed simultaneously on all sides.

In embodiments of such a method, provision is made such that the folding over of the upstanding, collar-like portion of the foil piece is accomplished in two steps and from opposite sides, whereby the upstanding portion is folded over as it would be in making a butt-fold. It is advantageous if in the first step no more than half of the upstanding portion of the foil is folded over. This will result in a larger visible surface on the outlying area which is to be folded over in the second step.

Figure 2:
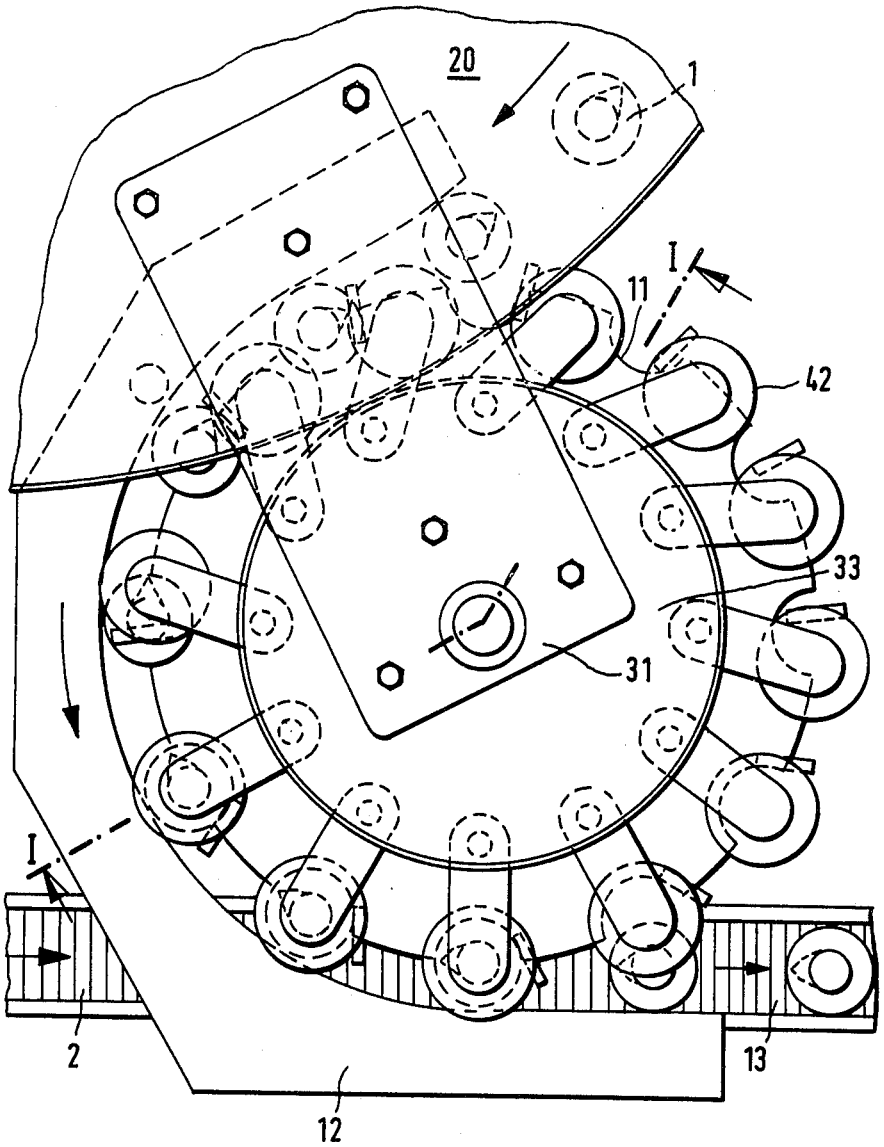
Figure 3:
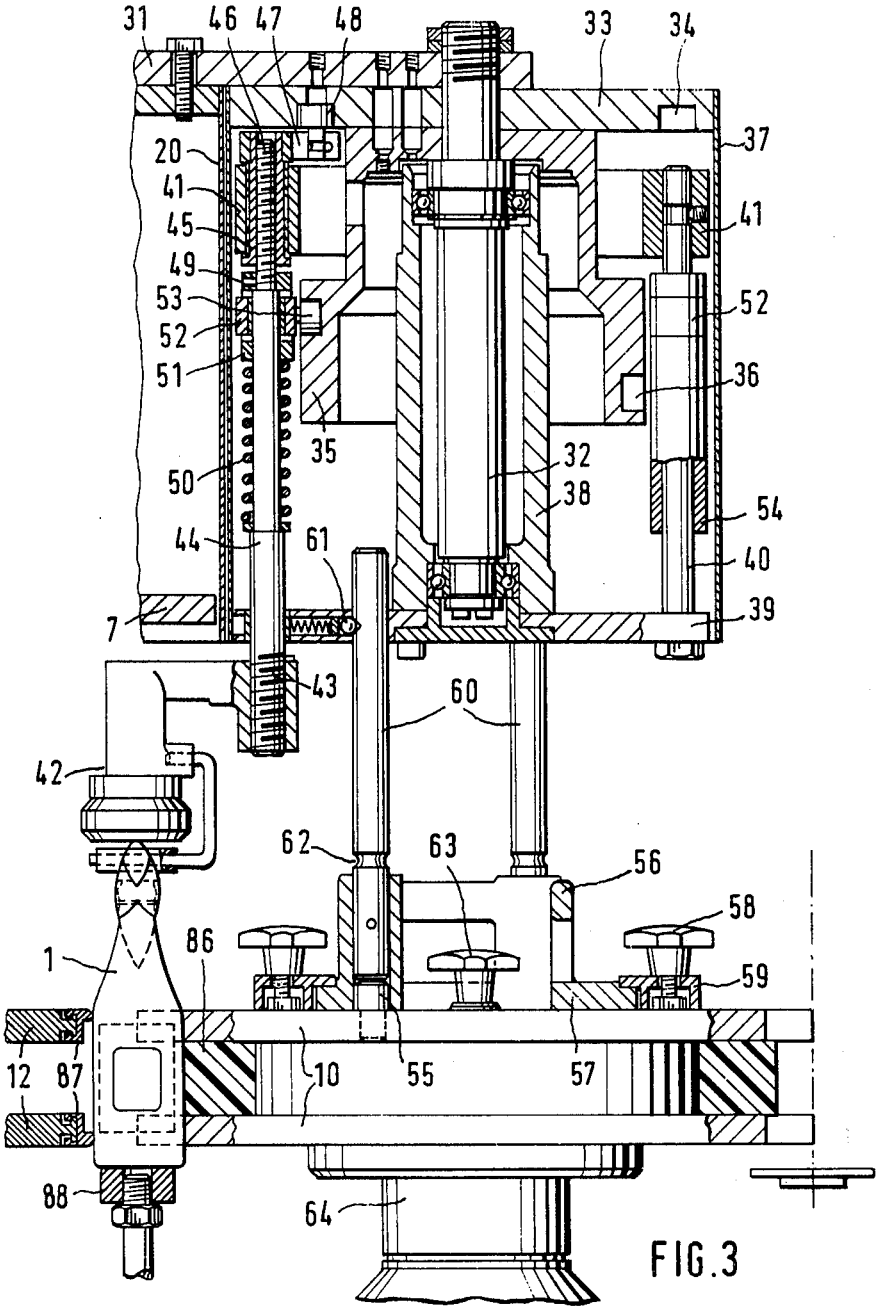
Figure 4:
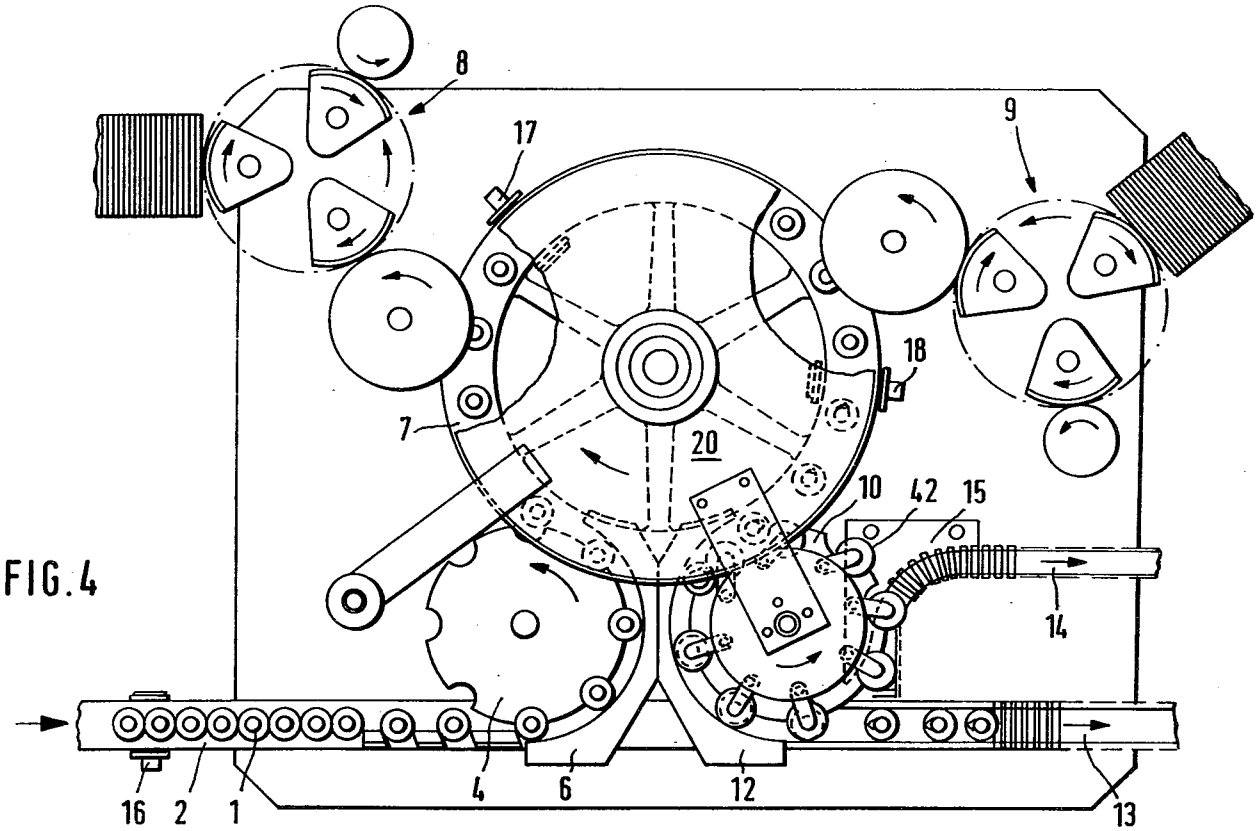
Figure 5:
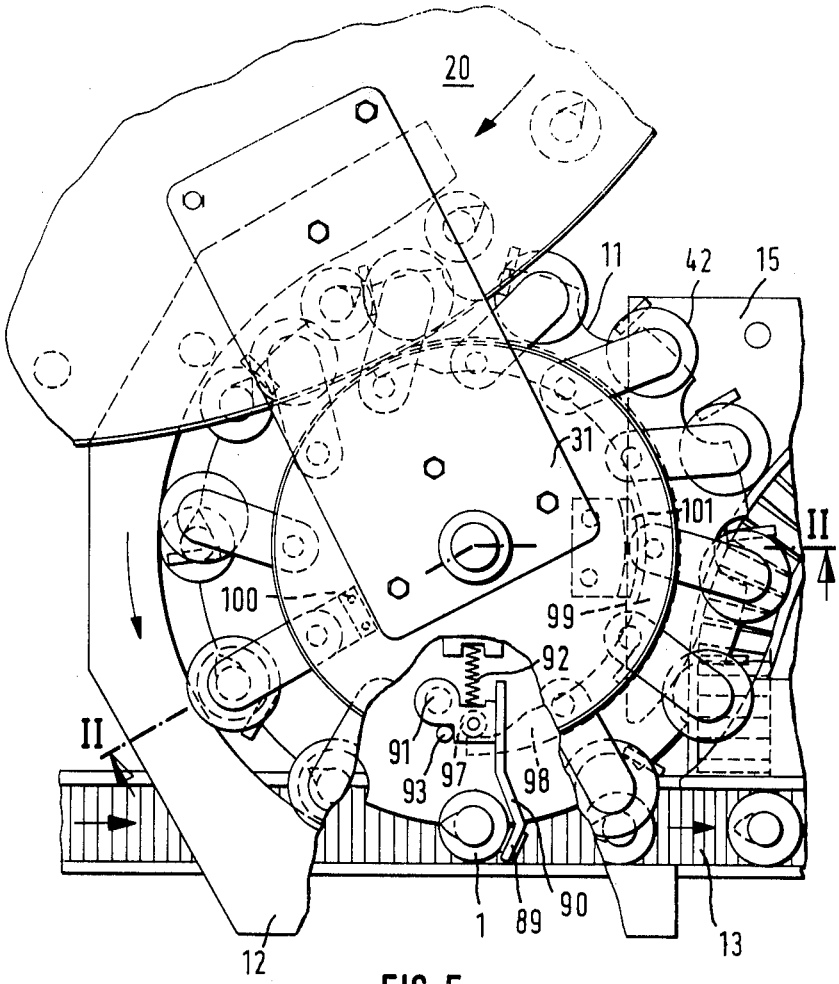
Figure 6:
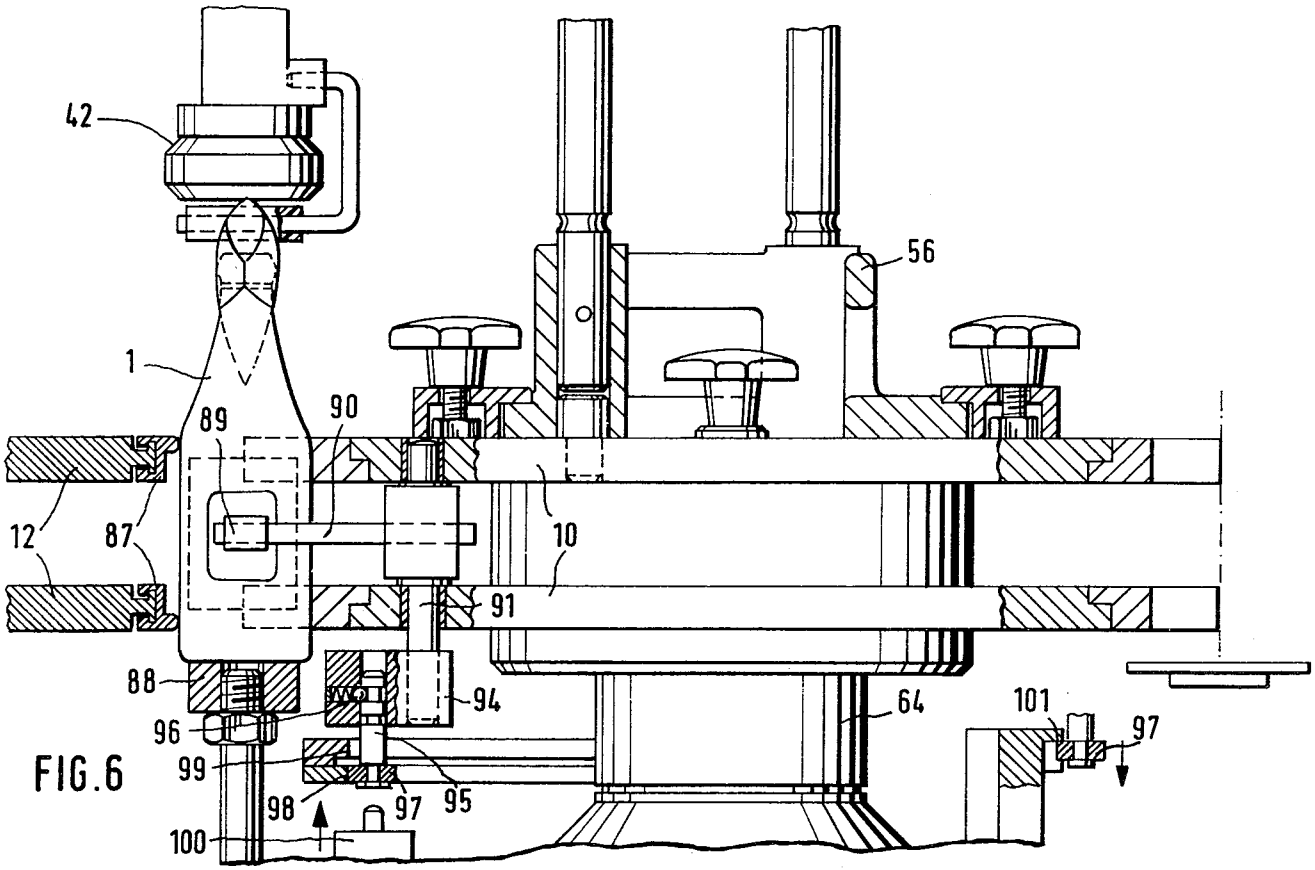
Figure 7:
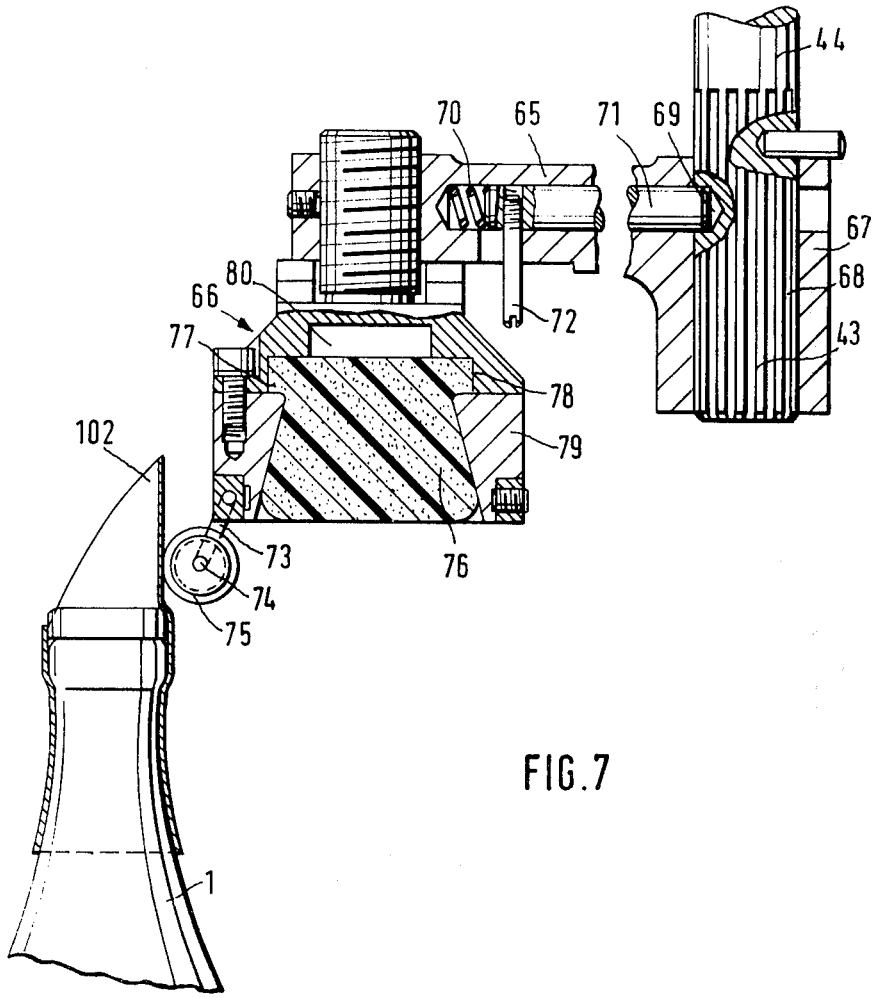
Figure 8:
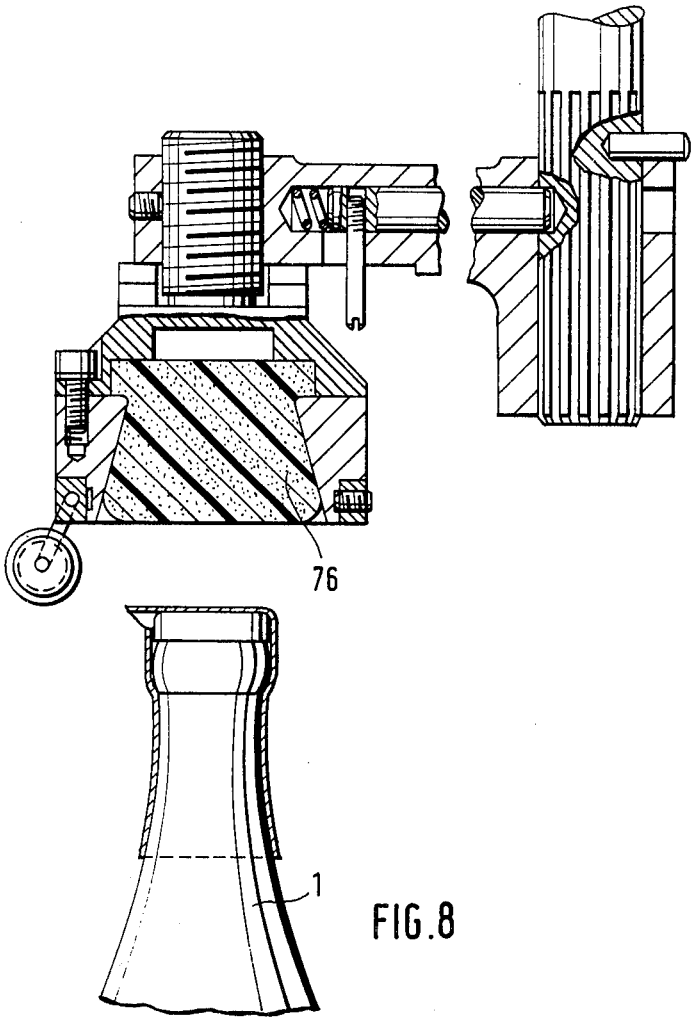
Figure 9:
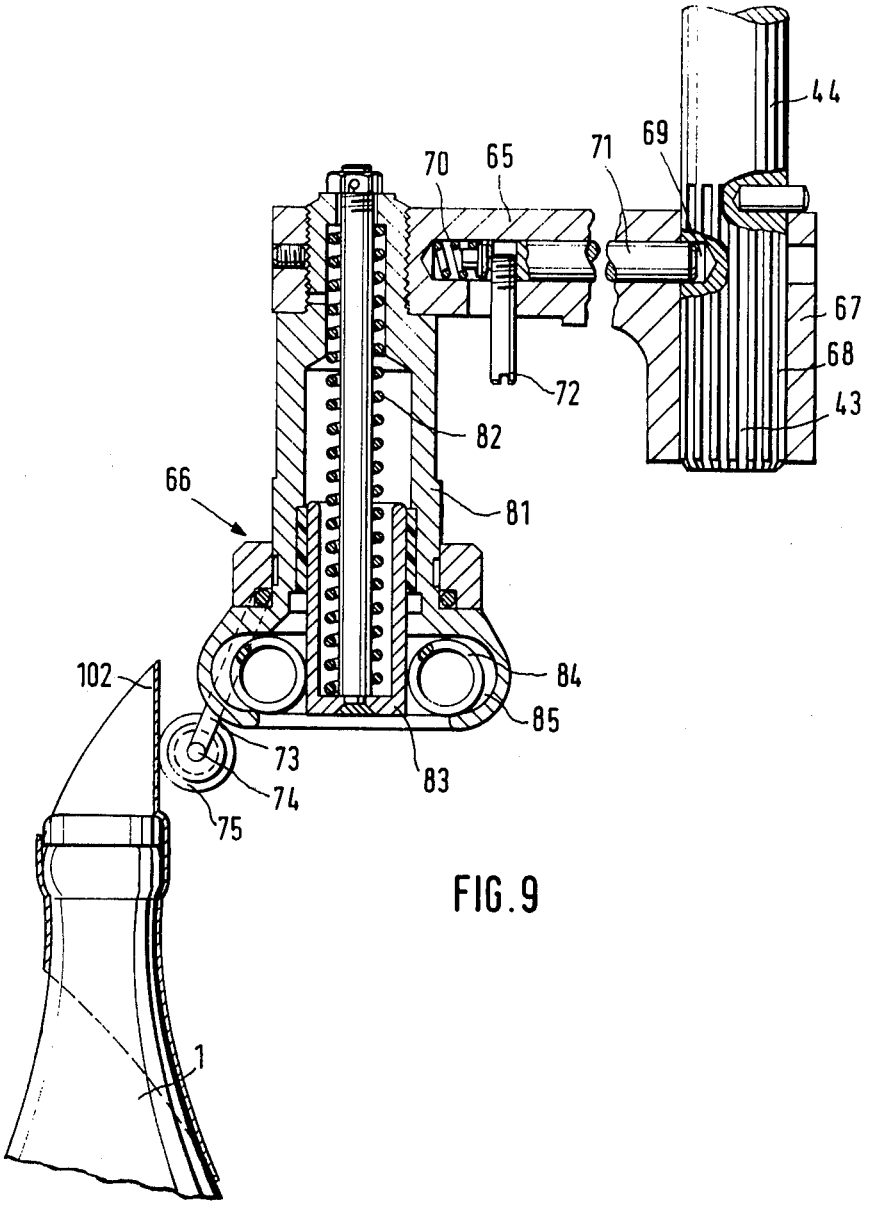
Figure 10:
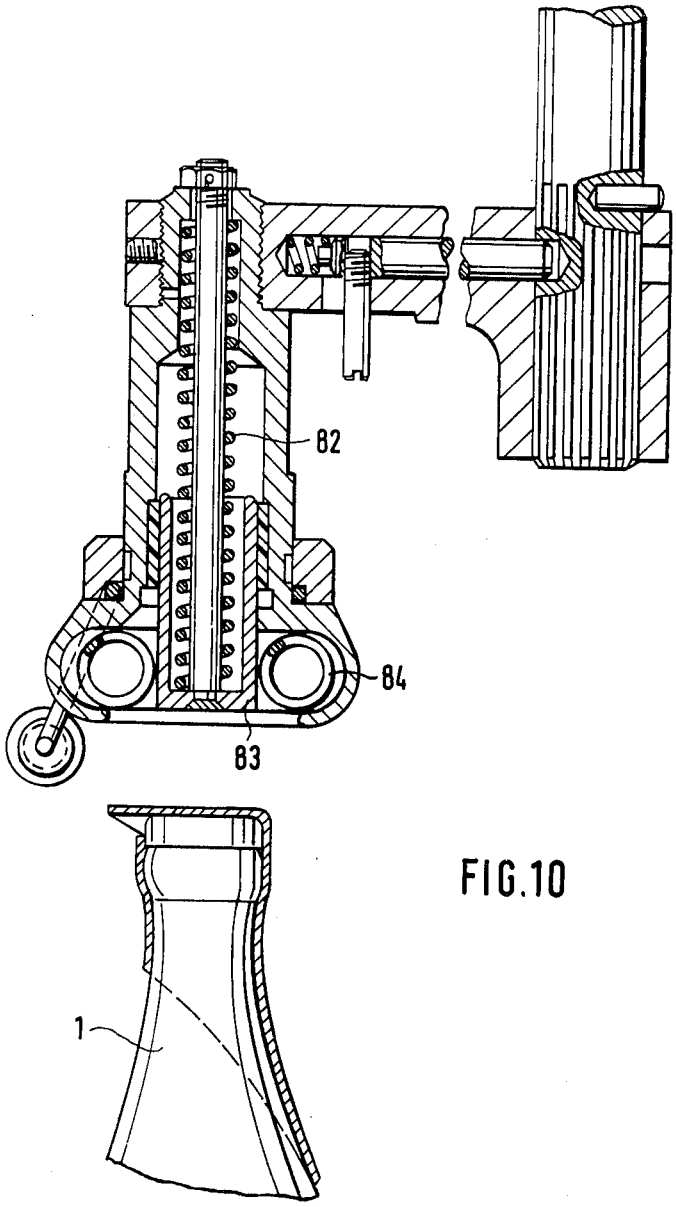
Figure 11:
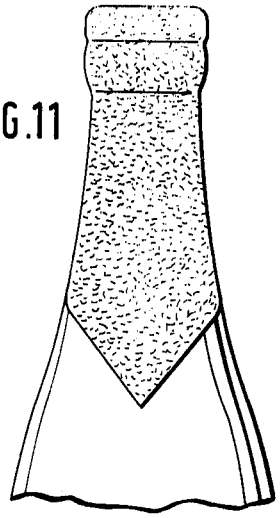
Figure 12:
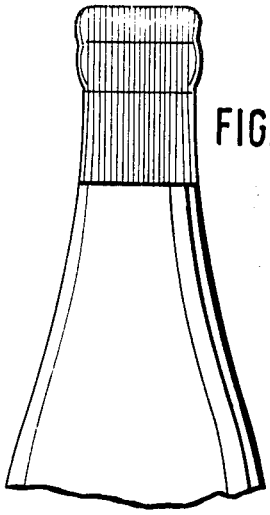
Figure 14:
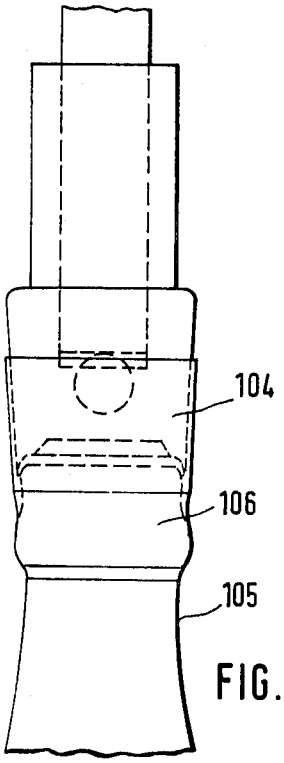
Figure 13:
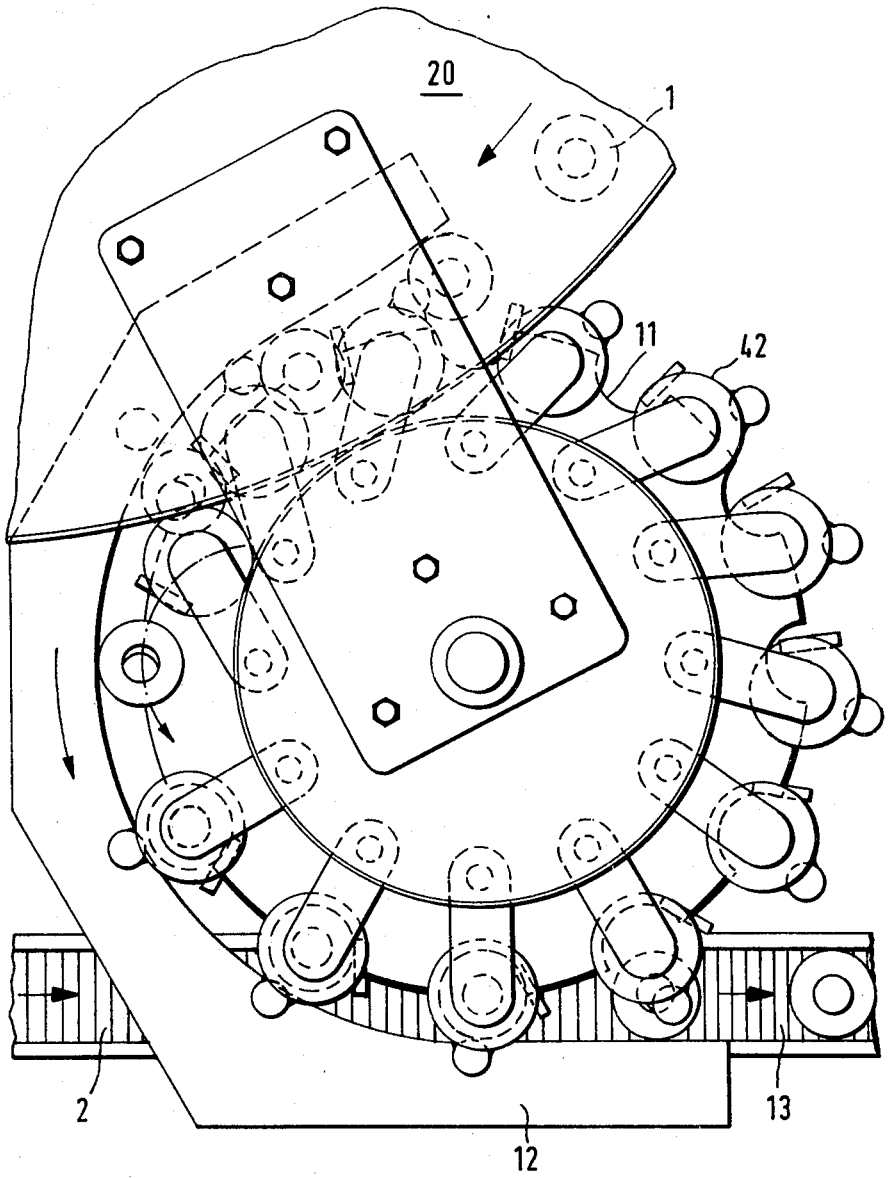
Figure 15:
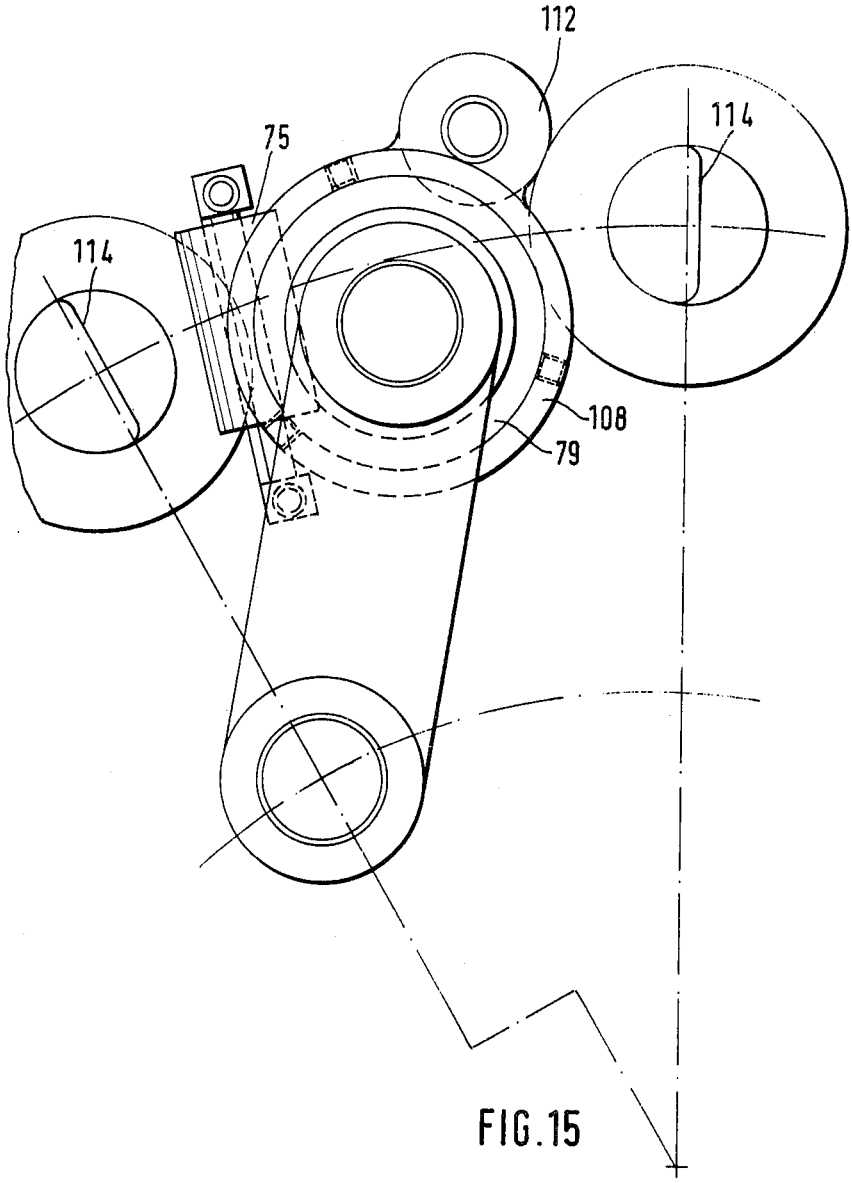
Figure 16:
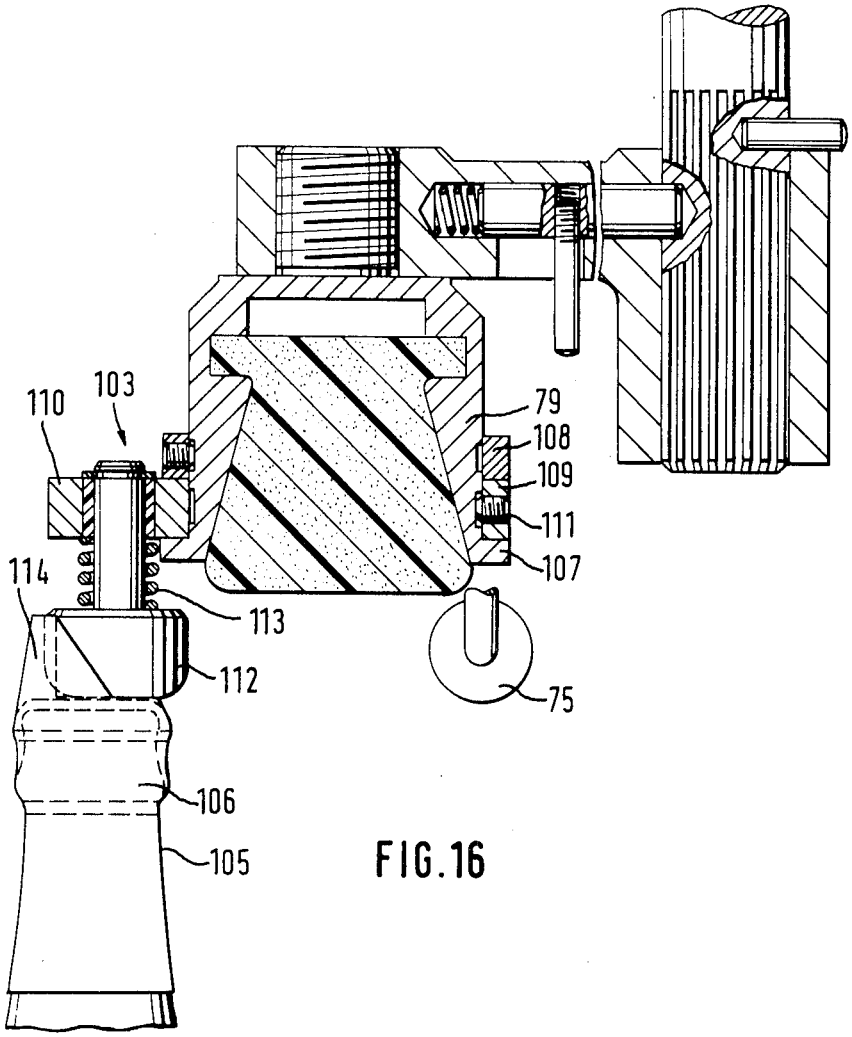
Figure 17:
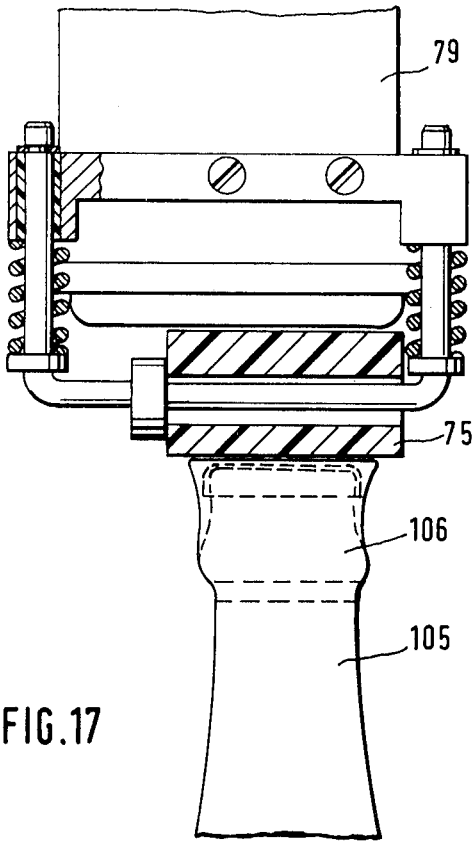

The invention will be further explained hereinafter in conjunction with a drawing representing embodiments, wherein:

FIG. 1 is a top view of a labeling machine with two labeling stations,

FIG. 2 is an enlarged top view of a part of the labeling machine of FIG. 1, namely the transfer wheel, FIG. 3 is an axial section along line I—I of the transfer wheel of FIG. 2, FIG. 4 is a top view of a labeling machine with two labeling stations of a form different from that of FIG. 1, FIG. 5 is an enlarged top view of a part of the labeling machine of FIG. 4, namely the transfer wheel, FIG. 6 shows the transfer wheel of FIG. 5 in an axial cross section on line II—II of FIG. 5, FIG. 7 shows a unit composed of down-folding means and a smoothing and pressing element in an axial cross section, before the folding down of the upstanding portion of the foil, FIG. 8 shows the unit of FIG. 7 after the folding down of the upstanding portion of the foil and before the smoothing and pressing, FIG. 9 is an axial cross section of a unit different from that of FIGS. 7 and 8, consisting of a down-folding means and a smoothing and pressing element, before the folding down of the upstanding portion of the foil, FIG. 10 shows the unit of FIG. 9 after the folding down of the upstanding portion of the foil and immediately before the smoothing and pressing, FIGS. 11 and 12 show two finished foil-capped bottles, one with a pointed foil and one with a pleated foil, FIG. 13 is an enlarged top view of a transfer wheel different from the transfer wheel of FIG. 2, having an additional down-folding means, FIG. 14 is a side view, partially in phantom, of a bottle top with the centering head superimposed thereon, immediately after the application of a rectangular patch of foil in the case of butt-folding, FIG. 15 is an enlarged top view of a unit having two down-folding means and one smoothing and pressing element in accordance with FIG. 13, at the point of transition from the turntable to the exit transfer wheel, FIG. 16 is a side view of the unit of FIG. 15 and FIG. 17 is a front view of the unit of FIG. 15.

The labeling machine represented in FIG. 1 consists essentially of a platform conveyor belt 2 delivering bottles 1 to be labeled and foil-capped, a dividing screw 3 which sets the bottles 1 apart at intervals corresponding to the division of the conveyor means next following, a first transfer wheel 4 having cupped receptacles 5 in which the bottles 1 are held by a stationary, arcuate guide 6, a turntable 7 which advances the bottles held in their receptacles past a first labeling station 8 and a second labeling station 9 and to a second transfer wheel 10 having cupped receptacles 11 disposed on its outer periphery, and to an arcuate guide 12 associated with these receptacles 11, and to a platform conveyor belt 13 carrying away the labeled and foil-capped bottles.

In the embodiment shown in FIG. 4, an additional, curved platform conveyor belt 14 having an arcuate guide 15 is provided for the segregation of faulty bottles. Imperfections are detected by means 16 for determining the fill level of the bottles and means 17 and 18 disposed at points following the labeling stations 8 and 9 for inspecting the front label and the foil cap and back label. The manner in which the platform conveyors 13 and 14 carrying perfect and imperfect bottles are operated will be described in detail further on.

The turntable 7 has at each receptacle for one bottle a rotationally controlled rotating plate not shown in the drawing, and a plunger that can be raised and lowered. The received bottle is gripped between the rotating plate and the plunger. By means of the controlled rotation of the rotating plate, the bottle is brought during transport into various rotational positions in which the front label and the foil as well as the back label can be transferred to the bottle. The rotational control also serves for bringing the bottles into a correct rotational position when they are treated by the means for pressing down the labels, brushes for example, which are not shown in the drawing and are situated after the labeling stations.

Above the turntable 7 there is disposed a hood 20 that is partially cut away in the drawing in the area of the labeling stations and is borne by an arm 19. The two labeling stations 8 and 9 have substantially the same construction. Each labeling station consists of a rotating carrier 21, 22, having pickup elements 23, 24, disposed thereon and rotating in opposite directions; these pickup elements, whose surfaces are coated with glue by the rotating glue rollers 25, 26, pick up labels from a label stack 27, 28, and transfer them to a rotating gripper cylinder 29, 30, which transfers the labels to the bottles 1 on which they are held by the glue. The pickup elements 23 of the labeling station 8 are of bipartite construction in order to be able to handle a body label and a foil patch, while at the labeling station 9 the pickup elements 24 are made in one piece so as to be able to handle a back label.

An arm 31 extending from the hood 20 of the turntable 7 carries a non-rotationally held, dependent shaft 32, a plate 33 with a stationary, planar cam 34, an inverted cup 35 with a stationary cylinder cam 36, and a cylindrical skirt 37 that is open at the bottom. A sleeve 38 is rotatably mounted on the shaft 32 and bears a disk 39 at its bottom end. A plurality of upright rods 40 are disposed on the disk 39 and bear at their top ends a ring 41 surrounding the cup 35.

As shown in FIG. 1, a pivoted unit 42 is associated with each receiver 11. Each unit 42 is mounted, as shown in FIG. 3, on the bottom end 43 of an operating spindle 44 which is mounted directly in the disk 39 and by means of a bushing 45 in the ring 41. The bushing 45 is mounted so as to be movable axially but it is held against rotation by means of a spline coupling on the upper end 46 of the operating spindle 44. The sleeve 45 bears a lever 47 which is operated by a cam follower 48 in the cam groove 34. The configuration of the cam groove 34 causes the bushing 45 to pivot and with it the spline-coupled operating spindle 44, and thus also pivots the unit 42. A ring 52 is mounted on the spindle 44 so as to be freely rotatable between a fixed stop 49 and a stop 51 biased by a spring 50, this ring being guided in the cam groove 36 by a cam follower 53. The operating spindle 44, and with it the unit 42, is moved up or down axially according to the configuration of the cam groove 36. To keep the cam follower 53 in engagement with the cam groove 36, the ring 52 is mounted on a sleeve 54 which is freely displaceable axially on the rod 40 directly adjacent it.

The transfer wheel 10 has on its upper side a plurality of studs 55 which can be inserted into corresponding bores of a base 56. The base 56 has an outer flange 57 which is gripped by dogs 59 which can be fastened by means of screws 58 to the transfer wheel 10. In this manner the base 56 is held positively on the wheel 10. The base 56 bears a plurality of upright coupling rods 60 which engage corresponding openings in the disk 39 and are held by means of ball catches 61. The coupling rods 60 have circumferential grooves 62 at the bottom which can be engaged by the ball catches 61 when the base 56 is released from the wheel 10 and raised upwardly. When the base 56 has been raised and units 42 have been dismounted, it is possible by removing one screw 63 to release the transfer wheel 10 from its column 64 and to replace it with a different one for a change of bottle size.

As best seen in FIGS. 7 to 10, the unit 42 consists of a head 66 borne by an arm 65. For the sake of simplicity of the drawing, the arms 65 and the heads 66 are represented in two axial cross sections at 90° to one another. The one end of the arm 65 has an eye 67 which is held nonrotatably but axially displaceably by means of a spline coupling 68 on the bottom end 43 of the drive spindle 44. A pin 71 biased by a spring 70 and engaged in a recess 69 in the end 43 of drive spindle 44 serves to lock the eye 67 axially thereon. An external projection 72 is engaged in the pin 71, and an operator can pull on it against the bias of the spring 70 to disengage the pin 71 from the recess 69, and the arm 65 can then be removed from the spindle end 43.

The head 66 carries on a resilient arm 73 a finger 74 disposed horizontally and transversely of the direction of the pivoting of the head 66, and transversely of the direction of transport of the bottles 1 in the transfer wheel 10, and on this finger a roller 75 is mounted in a freely rotatable manner. On account of the resiliency of the arm 73, the foldover means consisting of the finger 74 and the roller 75 can adapt within a certain range to different bottle top heights.

The embodiments of the unit 42, which in FIGS. 7 to 10 are identical up to this point, differ in the construction of the smoothing and pressing element.

The smoothing and pressing element of the embodiment represented in FIGS. 7 and 8 consists of a rotationally symmetrical sponge 76. The sponge 76 has the basic shape of a truncated cone with a collar 77 on the side opposite the bottle, and the collar 77 is fitted into an annular rebate 78 of a cup 79 adapted to the shape of the sponge 76. The bottom of the cup 79 has a central recess 80 into which the sponge can yield when pressure is exerted on its face.

In the embodiment represented in FIGS. 9 and 10, the head 66 also has an inverted cup 81 in which a centrally disposed plunger 83 is mounted so as to be displaceable against the force of a spring 82. Adjacent the bottom opening of the inverted cup 81 the plunger 83 is surrounded by an annularly shaped coil spring 84 of circular cross section, which is freely movable radially in an internal annular recess 85 of the cup 81.

In the embodiment represented in FIGS. 1 to 3, the transfer wheel 10 consists of two disks disposed at a distance from one another. Since the disks do not need to have bearings for rollers, they can be made of light material such as polyurethane foam, for example. Between the two disks there is a ring 86 of resilient material which extends partially into the cupped receptacles 11, as shown on the right in FIG. 3, and can be compressed by the bottles 1 transferred into the receptacles 11, as shown on the left in FIG. 3. The bottles 1 are held in the cupped receptacles 11 by the guide 12 which is provided with guide facings 87. The surface of ring 86 and the guide facings 87 which come in contact with the bottles 1 are coordinated with one another in regard to their coefficient of friction such that a higher friction occurs between the bottle 1 and the surface of ring 86, and a low friction between the guide facings 87 and the bottle 1, so that the bottles 1 are held non-rotatably in the receptacles 11 while they are being transported by the transfer wheel 10 and supported on a rail 88.

In the embodiment represented in FIGS. 4 to 6, clamps 89 are provided instead of the ring 86 effecting the holding of the bottles 1. Each clamp 89 associated with a receptacle 11 has a pivoting arm 90 which is disposed between the disks so as to be able to be pivoted by means of a shaft 91 rotatably mounted in the two disks of the transport wheel 10. The arm 90 is biased in the gripping direction by a compression spring 92. A stop 93 serves to limit the pivoting movement. A cam-controlled crank 94 engages the downwardly prolonged end of shaft 91 to control the clamp arm 90 affixed to the shaft 91. A pin 95 is axially displaceable in the clamp arm 90 and can be held in two axial positions by a detent 96. The pin 95 bears at its free bottom end a cam follower 97 which follows one or the other of two cams 98 and 99 disposed one above the other and running side by side, depending on the axial position of the pin 95. For the axial shift of cam follower 97 from the lower position, which is the basic position, to the upper position, there is provided an actuator 100 controlled by the sensing means 16, 17, 18. The lower cam 98 begins at the point of exit to the platform conveyor 13, while the upper cam 99 begins at the point of exit to the platform conveyor 14. To enable the cam follower 97 to enter the lower or upper cam 98, 99, it is necessary to shift the cam follower within a portion of the transport path which is free of either cam. The actuator 100 is consequently disposed in the cam-free area. To return the cam follower 97 to the basic position after it has been shifted to the upper position, the upper cam 99 merges with the lower cam 98 across a deflector 101 provided behind the exit to the platform conveyor 14. The configuration of the cams 98 and 99 is such that, when the lower cam 98 is being followed, i.e, when the bottle is perfect, the gripper 89 releases the bottle 1 to the exit to the platform conveyor 13, while in the case of a faulty bottle, the gripper 89 does not release the bottle 1 until it reaches the exit to platform conveyor 14. Cam 98 terminates at the turntable 7, and spring 92 then drives the clamp 89 in the gripping direction.

The two labeling machines described operate in the following manner:

The bottles 1 advance over the platform conveyor 2 to the labeling machine and are checked for fullness by the fill level detector 16. If the fill level is too low, a command is given to a controller which is not shown. The bottles 1, spaced out properly by the dividing screw 3, are taken from the first transfer wheel 4 and put into the receptacles of the turntable 7. The turntables and plungers gripping the bottles 1 between them hold the bottles during their transport to the first labeling station in a predetermined rotational position, so that the body label and the foil blank with one tip pointing downward and one projecting above the top can be attached centrally. The bottles are then rotated by the turntable bottle rotating means and moved past the smoothing devices disposed at fixed locations along the transport path. The bottles 1 then pass the second detector 17 which, in the event of faulty application of the body label or foil patch, gives a command to the controller. Before the bottles reach the second labeling station 9, they are rotated to a position in which the backs of the bottles are facing the labeling station 3. In this rotational position, the back label can be applied. After the second labeling station 9, the bottle 1 is checked by the third detector 18 for correct application of the back label and a command is given, if necessary, to the controller. As transport continues, the bottles are turned to a position in which the smoothing means disposed along the transport path can smooth the back label down completely, and in which the upstanding tip of the foil blank is to the rear with reference to the direction of transport. In these figures, this position is represented by a rearwardly pointing tip.

When the bottles 1 reach the area of the transfer wheel on the exit side, the cam-controlled units 42 of the receptacles 11 coming into the transfer range are pivoted rearwardly, so that the bottles 1 can be transferred without hindrance to the cupped receptacles. As soon as the bottle transferred to the receptacle 11 is gripped by the guide 12 and also by the clamps 89 if any, the grip on the bottle between the rotating plate and the plunger of the turntable 7 is released. While the bottles 1 are being transported in the area of the arcuate guide 12, the unit 42 is first pivoted under the control of the cam 34, and the down-folding means 74, 75, folds down the upstanding portion 102 of the foil patch. As soon as the head 66 is centrally above the bottle 1, it is lowered under the control of the cam 36, while the central portion of the face of sponge 76 or the face of the plunger 84 presses the foil blank flat onto the top of the bottle, while the adjacent area of the face of sponge 76 or the annular coil spring 84 rolls the foil patch on all sides against the adjoining magin of the top of the bottle. Since a relatively large portion of the transport path is available for the down-folding process, the foil blank is folded down with the greatest possible gentleness. The smoothing and pressing is also performed by the rolling movement of the smoothing elements in a very gentle manner. The head 66 is then raised up again and as travel continues it is swung back to the starting position by the time it reaches the transfer point on the turntable.

According to the commands which the detecting means 16, 17 and 18 have given to the controller, the controller operates the actuator 100 and, in the case of a faulty bottle, shifts the cam follower 97 to the upper position in which it cooperates with the cam 99 which does not release the clamp 89 until the exit to the platform conveyor is reached. In the case of a perfect bottle, however, the cam follower 97 remains in its lower position, so that the clamp 89 is released at the exit to the platform conveyor 13.

In the case of the embodiment in FIGS. 3 to 6, therefore, the clamp 89 has two functions, namely to hold the bottles against rotation during transport, and then to release them to one or the other platform conveyor 13 or 14 according to whether faults are found in them. In the case of the embodiment in FIGS. 1 to 3, however, which is distinguished by its simple design, such discrimination between perfect and faulty bottles does not take place.

The embodiment represented in FIG. 13 is the same as that of FIGS. 6 to 8 except for an additional down-folding means 103 carried by each unit, so that the following description can be limited to this additional down-folding means and to the centering head 104 disposed in the area of each cupped receptacle 5 of the turntable 7.

As FIG. 14 shows, the centering head 104 has a slightly truncoconical outer periphery which at the bottom has a diameter that is the same as the diameter of the bottle top, while at its upper part it has a slightly larger diameter. When the rectangular foil patch 105 is applied to the bottle, the centering head 104 is lowered onto the bottle top 106, so that the centering head 104 merges smoothly with the bottle top 106. The patch of foil 105 can therefore be laid onto the bottle neck, the bottle top 106 and the centering head 104 without undesirable deformation. After the patch is laid on, the centering head 104 is raised and the bottle, with the patch still upstanding in the shape of a crown or collar, is transferred to the exit transfer wheel 10. The bottle is then treated, as described above, by the unit 42.

In accordance with FIGS. 15 to 17, the cup 79 of the smoothing and pressing element 76 to 80 bears a collar 107, and between this collar and a ring 108 that can be clamped on the cup 79, an eye 109 of a supporting arm 110 of the additional down-folding means 103 is fixed in the axial direction. The supporting arm 110 can be adjusted in its rotational position on the cup 79. By means of the set screw 111 it can be locked against rotation. The actual down-folding means in the form of a plunger 112 is mounted in the supporting arm 110 axially against the force of a spring 113. While the down-folding member 75 is so positioned that, when the unit 42 is pivoted counterclockwise, it can be moved from the rear over the upstanding part of the foil, the plunger 112 is positioned opposite the down-folding means 75 such that, when the unit 42 pivots clockwise, it can be moved to the center of the bottle top 106. In these pivoting movements, the down-folding means 75 and 112 fold down the upstanding blank portions, not of the same bottle but of adjacent bottles.

As FIG. 13 shows, the units 42 at the point of transfer from the turntable 7 to the exit transfer wheel 10 are turned to a position between the receptacles 11, in which they do not interfere with the transfer of the bottles to the exit transfer wheel 10. As soon as the bottle has been taken over by the exit transfer wheel 10, the unit 42 pivots counterclockwise. Thereupon the plunger 113 lays down a forwardly situated part of the upstanding portion of the patch 105 which has been applied to the bottle with its top and bottom edges horizontally disposed, this action being represented in FIG. 16. This action is comparable to a butt-folding action which avoids excessive local pile-up of material. As the exit transfer wheel 10 continues to rotate, the unit 42 is pivoted back again, i.e., clockwise. The smoothing means 75 thus passes over the still upstanding portion 114 of the patch that has already been partially laid down by the preceding unit, and thus flattens down this still upstanding portion as shown in FIG. 17. Then, as described in the other embodiments, the cup 79 is lowered, pressing down the down-folded portions 114.

It will be understood that the specification and examples are illustrative but not limitative of the present invention and that other embodiments within the spirit and scope of the invention will suggest themselves to those skilled in the art.

We claim:

1. In an apparatus for the foiling of bottles with a patch, having at least one point, comprising a turntable which has several controlled bottle turning means disposed at its periphery, at least one labeling station which transfers the foil patches to the bottles moved past it by the turntable and brought to a certain rotational position by the bottle turning means, elements for pressing down the foil patches transferred to the bottles, the elements being disposed along the transport path of the bottles, and a transfer wheel disposed after the turntable and provided with receiving places for the bottles, the transfer wheel having a clamping means for the bottles and means for turning and pressing down patch ends projecting above the tops of the bottles, the improvement which comprises clamping means holding the bottles against rotation on the entire transport by the transfer wheel, the turning and pressing means including a plurality of units disposed above the transfer wheel and turning with the transfer wheel, each unit being associated with one receiving place, means for pivoting each unit in coordination with the rotational movement of the transfer wheel from a first position laterally alongside the corresponding receiving place to a second position over the corresponding receiving place, means for lowering each unit in its second position axially against the top of a bottle held in the receiving place, a fold-down device, and a smoothing and pressing element disposed behind the fold down device in the direction of pivoting from the first position to the second position and, when lowered, gripping the bottle top on all sides.

2. An apparatus according to claim 1, including two labeling stations of which the first in the circumferential direction of the turntable transfers a front label and a foil patch and the second labeling station in the circumferential direction transfers a back label, the pivoting movement of each unit from the first position to the second position being in the same direction as that of the rotation of the transfer wheel.

3. An apparatus according to claim 1, wherein the clamping means urges the bottles against a pad having a surface with a high coefficient of friction and includes a guide disposed on the outer circumference of the transfer wheel, which guide has a surface with a lower coefficient of friction.

4. An apparatus according to claim 1, wherein the clamping means includes a clamp controlled in relation to the rotatory movement of the transfer wheel.

5. An apparatus according to claim 4, wherein the transfer wheel has two outlets controllable by a first control means, and including second control means having priority over the first control means and means for detecting defects in the labels pursuant to which the first control means opens one of the two outlets.

6. An apparatus according to claim 5, wherein the first control means includes two parallel fixed cams, and the second control means includes an actuator which can selectively engage the drive of the clamps.

7. An apparatus according to claim 6, wherein the actuator is disposed in a cam-free area, the cam follower of the drive of the clamps being shiftable by the actuator from its fundamental position associated with the first cam to a position associated with the second cam, the cam follower being snap-fastenable in the second position and being returnable to its basic position by means of a switch at the end of the second cam.

8. An apparatus according to claim 1, including a first fixed cam common to all units for the control of the pivoting movement of all the individual units.

9. An apparatus according to claim 1, including a second fixed cam common to all units for the control of the descending movement of all the individual units.

10. An apparatus according to claim 1, including a frame in which the units are dependently mounted, the frame being disposed above the transfer wheel and being driven by the transfer wheel through a driver unit.

11. An apparatus according to claim 10, wherein the units are mounted removably on drive spindles projecting out of the underside of the frame.

12. An apparatus according to claim 10, wherein the driver unit is mounted axially displaceably and lockably in the frame and can be coupled positively to the upper side of the transfer wheel.

13. An apparatus according to claim 1, wherein the smoothing and pressing element includes a central portion for the top of the bottle, which central portion resiliently yields upon pressing, and an outer annular portion enveloping the edge of the bottle top when the central portion yields.

14. An apparatus according to claim 13, wherein the central portion and the annular portion are constituted by an integral sponge.

15. An apparatus according to claim 14, wherein the sponge is supported at its back and its sides by the bottom and the walls of a cup.

16. An apparatus according to claim 15, wherein the bottom of the cup has a central recess.

17. An apparatus according to claim 14, wherein the sponge has the shape of a truncated cone whose larger end faces the bottle top.

18. An apparatus according to claim 15, wherein the sponge on its circumference has a collar by means of which it can be matingly held in a corresponding recess in the cup.

19. An apparatus according to claim 13, wherein the central portion is a resiliently supported plunger and the annular portion is mounted radially loosely in an internal annular recess of a holder.

20. An apparatus according to claim 19, wherein the annular portion comprises a coil spring.

21. An apparatus according to claim 19, wherein the annular portion is circular in cross-section.

22. An apparatus according to claim 19, wherein the stroke performed upon the lowering of a unit reaches to the area of the neck of a bottle.

23. An apparatus according to claim 1, wherein each unit includes foldover means having a finger disposed transversely to the pivoting movement.

24. An apparatus according to claim 23, wherein the finger bears a freely rotatably mounted roller.

25. An apparatus according to claim 23, wherein the foldover means is resiliently supported.

26. An apparatus according to claim 1, wherein each unit is pivotable from its first position to a third position opposite the second position with respect to the first position and bears an additional foldover means which corresponds in its radial dimensions to the patch area projecting collar-like, and is situated closely above the top of a bottle when in the third position.

27. An apparatus according to claim 26, wherein the additional foldover means is in the form of a plunger.

28. An apparatus according to claim 26, wherein the additional foldover means is mounted in a resiliently yielding manner.

29. An apparatus according to claim 1, wherein the bottle turning means of the turntable has a centering head with a substantially cylindrical or slightly truncoconical outer periphery of the same outside diameter as the top of the bottle and serving as a mold for a collar-like projecting area of each patch when the patch is transferred and laterally applied in the turntable.

* * * * *